US005568889A

United States Patent [19]

Holloway, Jr. et al.

[11] Patent Number: 5,568,889

[45] Date of Patent: Oct. 29, 1996

[54] TOOL HOLDER

[76] Inventors: Leon F. Holloway, Jr., 4700 W. 185th St., Country Club Hills, Ill. 60478; Jesse L. Davis, Jr., 7 E. 113th Pl., Chicago, Ill. 60628

[21] Appl. No.: 414,940

[22] Filed: Mar. 31, 1995

[51] Int. Cl.[6] ..... B25B 29/00

[52] U.S. Cl. ..... 224/661; 224/222; 224/904; 224/674; 224/677; 224/680; 224/682; 224/683

[58] Field of Search ..... 224/253, 904, 224/226, 227, 222, 252

[56] References Cited

U.S. PATENT DOCUMENTS

| | | | |
|---|---|---|---|
| 4,300,708 | 11/1981 | Pattermann | 224/253 |
| 5,201,448 | 4/1993 | Schue | 224/253 |
| 5,409,153 | 1/1995 | Ristich | 224/253 |

*Primary Examiner*—Renee S. Luebke

*Attorney, Agent, or Firm*—Ladas & Parry

[57] ABSTRACT

A foldable tool holder for organizing the tools and supplies of a skilled tradesman is disclosed. The tool holder has an inverted-L-shaped support with a first and a second side. A first pocket is attached to the upper front corner of the first side of the support. A second pocket is attached to the first side of the support adjacent to the first pocket. A third pocket for elongated substantially cylindrical objects such as drill bits, allen wrenches, hole punches, nail sets, files, and screwdrivers is attached to the first side of the support below the first pocket. A fourth pocket for holding an oblong tool such as a razor knife, wire stripper, fuse puller, ratchet, or pocket knife is attached to the front side of the second pocket. A fifth pocket for holding a writing instrument is attached to the front side of the third pocket. The tool holder is secured to the waist of the user by inserting a belt in a tunnel of material at the top of the support. The bottom of the tool holder is secured to the thigh of the user by an adjustable lateral strap with a releasable fastener.

8 Claims, 1 Drawing Sheet

TOOL HOLDER

BACKGROUND OF THE INVENTION

The present invention relates to the field of tool holders. In particular, the invention relates to a tool holder worn at the belt by workers in the skilled trades, such as electricians, machinists, and the like.

Skilled tradesmen select from a wide variety of tools and supplies depending on the project to be completed. Often, skilled tradesmen work at project sites which are a significant distance from the factory tool room, a tool van, or gang box. In addition, skilled tradesmen working in a factory setting may need to have both hands free to safely reach work sites that are only accessible by ladders or overhead walkways with safety rails. Consequently, skilled tradesmen have developed unique tool holders and utility belts that allow them to keep both hands free while transporting tools and supplies to a work site.

The design and fabrication of tool holders and utility belts is a well known art. The tool holders and utility belts found in the prior art are often dedicated to specific industries. Devices available include tool holders for carrying power tools, solder guns, axes, revolvers, and writing instruments. Frequently, the specific tool holders available do not meet the needs of a skilled tradesman. Moreover, designing a tool holder that fits specific tools tends to increase manufacturing costs.

Tool holders known in the art can be bulky and cumbersome because of problems associated with their design as well as the size of the tools they are designed to carry. A tool holder that facilitates the carrying of the tool may also be difficult to carry and store when not in use. Accordingly, skilled tradesmen working in tight confines with limited spaces demand a streamlined tool holder which will remain securely fastened to their person while facilitating ease of access to the tools and an organized method for selecting the same.

For the foregoing reasons, there is a need for a light, compact, foldable tool holder that organizes the tools and supplies of a skilled tradesman and that can be inexpensively manufactured.

SUMMARY OF THE INVENTION

The present invention is directed to a tool holder that satisfies the need for an easily manufactured, light, compact, foldable tool holder that can be worn at the belt of a worker in the skilled trades. The tool holder includes a flexible, inverted-L-shaped having a first side and a second side. The tool holder has a first pocket attached to the upper front corner of the first side of the support, and a second pocket attached to the support adjacent to the first pocket. A third pocket for holding elongated essentially cylindrical objects such as screwdrivers, drill bits, allen wrenches, hole punches, files, nail sets, and the like is attached to the front side of the support below the first pocket. A fourth pocket for holding shorter oblong tools and/or objects such as a razor knife, fuse puller, wire stripper, ratchet, or pocket knife is attached to the front side of the second pocket. A fifth pocket for carrying a writing instrument or other such long cylindrical object is attached to the front side of the third pocket.

The tool holder has a flap member that extends from the top edge of the support to an upper portion of the back side of the support. The flap member is secured to the back side of the support, resulting in a tunnel of material that receives the belt of the user. The bottom edge of the support is attached to a fastening means that encircles the thigh of the user and holds the tool holder tightly against the user.

In another embodiment of the invention, the interior of the third pocket has a plurality of loops for separating the elongated essentially cylindrical objects that are placed in the third pocket.

BRIEF DESCRIPTION OF THE DRAWINGS

These and other features, aspects, and advantages of the present invention will become better understood with regard to the following description, appended claims, and accompanying drawing where

DETAILED DESCRIPTION OF THE INVENTION

Figure 1:
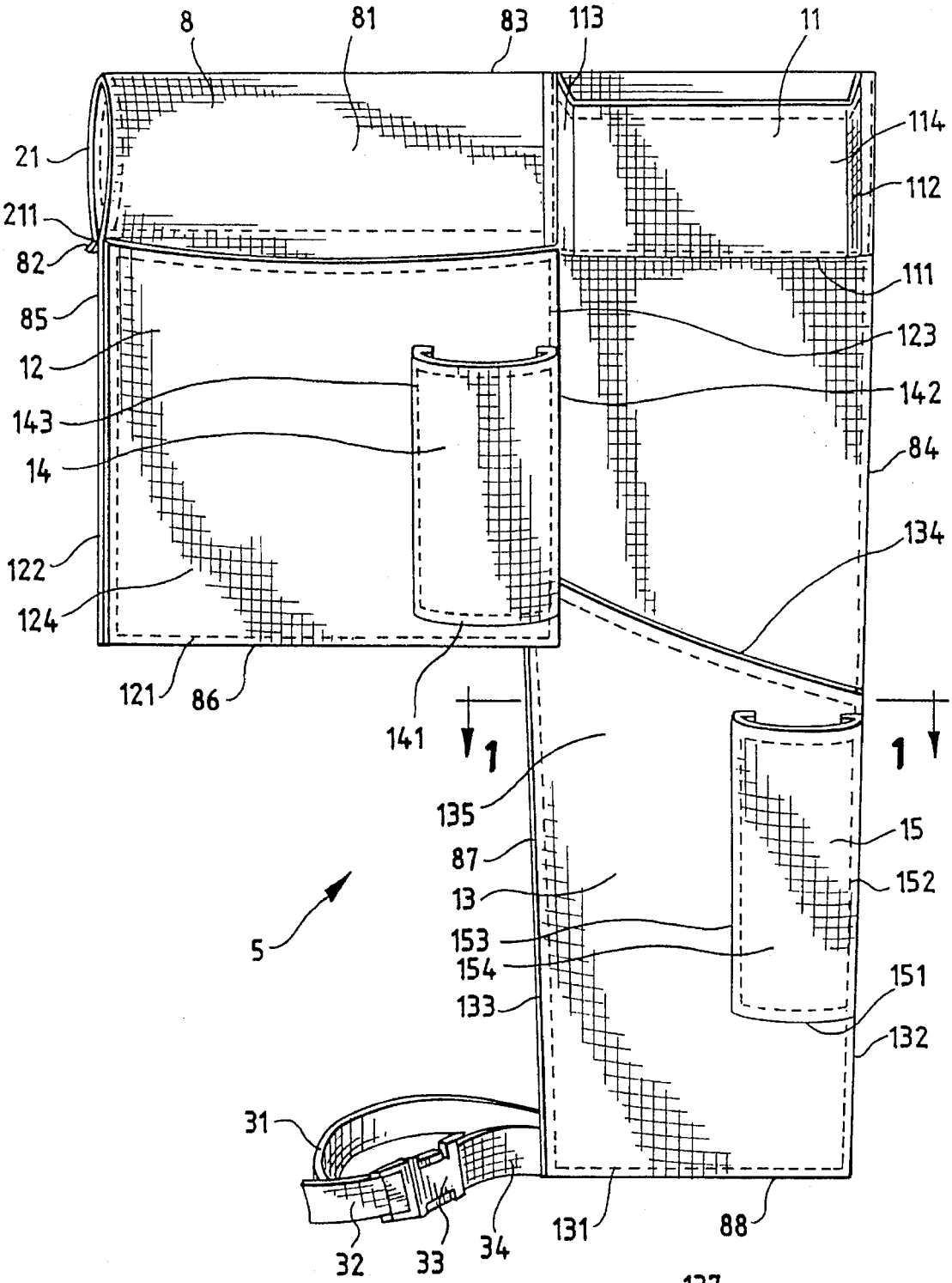
FIG. 1 shows a perspective view of the right hand version of the tool holder and FIG. 2 shows a cross-sectional view of the tool holder of FIG. 1 taken along line 1—1.

FIG. 1 shows a tool holder 5 according to the right hand embodiment of the invention. The tool holder 5 is worn secured against the body at the right side of the waist and the right thigh. Tool holder 5 has an inverted-L-shaped support 8 made from a flexible material, preferably a wear resistant fabric. The materials contemplated include cotton based textiles or fabrics from synthetic materials such as polyesters, acetates, polyurethanes, polyamides, or polyvinyl chlorides to light flexible leathers, synthetic leathers and the like. The selected material should be sufficiently flexible to allow the support to be folded upon itself without permanently deforming. Support 8 has a front side 81 and a back side 82. Support 8 has a substantially straight top edge 83 and a front edge 84, that is substantially normal to the top edge 83. Support 8 has an upper rear edge 85 substantially normal to the top edge 83. The upper rear edge 85 extends down to a point between the ends of the front edge 84. Support 8 has an upper bottom edge 86, that is substantially normal to the upper rear edge 85. The upper bottom edge 86 extends laterally from the upper rear edge 85 to a point between the ends of the top edge 83. Support 8 has a lower rear edge 87, that is substantially normal to the upper bottom edge 86. The lower rear edge 87 extends downward from the upper bottom edge 86 to a position substantially normal to the bottom of the front edge 84. Support 8 has a lower bottom edge 88, that is normal to the front edge 84. The lower bottom edge 88 forms a substantially right angle with the lower rear edge 87.

The tool holder 5 has a first pocket 11 attached to the front side 81 of the support 8 near the intersection of the top edge 83 and the front edge 84. The first pocket 11 has a bottom wall 111, that extends outward from the support 8. The first pocket has side walls 112 and 113, that extend upward from the bottom wall 111. The first pocket has a front wall 114, that extends upward from the bottom wall 111. The bottom wall 111 extends laterally from the front edge 84 of the support 8 to a point between the ends of the top edge 83 of the support 8. The side walls 112 and 113 extend downward from the top edge 83 of the support 8 to a point between the ends of the upper rear edge 85. The bottom wall 111 and the side walls 112 and 113 of the first pocket 11 are attached to the support 8 by a suitable means such as stitching. The first pocket 11 is advantageously sized to carry a tape measure. Alternatively, smaller objects used in the various trades such as wire nuts for electricians or nails for carpenters or the like can be placed in the first pocket 11.

The tool holder 5 has a second pocket 12 attached to support 8 near the intersection of the upper rear edge 85 and the upper bottom edge 86 of the support 8. The second pocket 12 has a bottom edge 121 attached to the upper bottom edge 86 of the support 8. The bottom edge 121 of the second pocket 12 has substantially the same length as the upper bottom edge 86 of the support 8. The second pocket 12 has a first edge 122 attached to the upper rear edge 85 of the support 8. The second pocket 12 has a second side edge 123 that is attached to the front side 81 of the support 8. The second side edge 123 is substantially in-line with the lower rear edge 87 of the support 8. The second pocket 12 also has a front side 124. The second pocket 12 is advantageously sized to fit larger tools used in the trade such as screwdrivers, pliers and the like.

Figure 2:
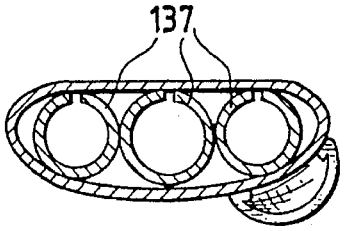

The tool holder 5 has a third pocket 13 attached to support 8 between the lower rear edge 87 and the front edge 84 of the support 8. The third pocket 13 has a bottom edge 131 that is substantially the same length as the lower bottom edge 88 of the support 8. The third pocket 13 has a first side edge 132 attached to the front edge 84 of the support 8. The third pocket 13 has a second side edge 133 attached to the lower rear edge 87 of the support 8. The third pocket 13 has a top edge 134 that is inclined upward from the first side edge 132 of the third pocket 13. The first side edge 132 and the second side edge 133 of the third pocket 13 extend upward from the bottom edge 131 of the third pocket 13 to a position between the ends of the front edge 84 of the support 8. The third pocket 13 also has a front side 135. The third pocket 13 is advantageously sized for elongated essentially cylindrical objects such as screwdrivers, allen wrenches, drill bits, hole punches, files, and nail sets. The interior of the third pocket 13 has a plurality of generally circular retaining loops 137 shown in FIG. 2, which keep the cylindrical objects separated when they are placed in the third pocket 13.

The tool holder 5 has a fourth pocket 14 attached to the second pocket 12. The fourth pocket 14 has a bottom edge 141 attached to the front side 124 of the second pocket 12. The fourth pocket has a first side edge 142 that is attached to the first side edge 122 of the second pocket 12. The fourth pocket 14 has a second side edge 143 attached to the front side 124 of the second pocket 12. The fourth pocket 14 is advantageously dimensioned to hold a shorter oblong tool such as a razor knife, fuse puller, wire stripper, ratchet, or pocket knife.

The tool holder 5 has a fifth pocket 15 attachably disposed on the outer portion of the third pocket 13. The fifth pocket 15 has a bottom wall 151 that extends outward from the front side 135 of the third pocket 13. The bottom wall 151 of the fifth pocket 15 is substantially circular. The fifth pocket 15 has a first side edge 152 that is attached to the first side edge 132 of the third pocket 13. The fifth pocket 15 has a second side edge 153 that is attached to the front side 135 of the third pocket 13. The fifth pocket 15 has a substantially cylindrical front wall 154 that extends upward from the bottom wall 151 of the fifth pocket 15. The fifth pocket 15 is advantageously dimensioned to hold a writing instrument such as a pen, pencil, marker, or scriber.

A flap member 21 extends downward from the top edge 83 of the support 8 to an upper portion of the back side 82 of the support 8. The flap member 21 has a bottom edge 211 that is attached to the back side 82 of the support 8, whereby a tunnel of material for receiving a belt is formed.

The tool holder 5 has thigh belt 31 attached to the lower bottom edge 88 of the support 8. The thigh belt 31 allows the user to secure the tool holder 5 to his or her thigh. The thigh belt 31 is shown as having a latch 32, a clasp 33, and a strap 34. The length of the thigh belt 31 can be adjusted so the thigh belt 31 tightly encircles the thigh of the user, regardless of the user's size.

Of course other embodiments are contemplated wherein the thigh belt may comprise a tie type of strap or a strap with a hook and loop fastener system on its ends for adjustably fastening the device to the user's thigh. It is contemplated that a hook and loop fastener such as the type commonly sold under the tradmark "VELCRO" would be suitable for use on the strap.

In another embodiment of the present invention (not shown), the elements of the tool holder are rearranged so the tool holder can be secured at the left side of the waist and the left thigh.

We claim:

1. A tool holder comprising:

a flexible, inverted-L-shaped support having a first side, a second side, a top edge, a front edge substantially normal to the top edge, an upper rear edge substantially normal to the top edge, the upper rear edge extending downward to a position intermediate to the ends of the front edge, an upper bottom edge substantially normal to the upper rear edge, the upper bottom edge extending laterally from the bottom of the upper rear edge to a position intermediate to the ends of the top edge, a lower rear edge substantially normal to the upper bottom edge, the lower rear edge extending downward from the upper bottom edge to a position normal to the bottom of the front edge, and a lower bottom edge substantially normal to the front edge, the lower bottom edge forming a substantially right angle with the lower rear edge;

a first pocket having a bottom wall attached to the first side of the support, the bottom wall of the first pocket extending outward from the first side of the support, side walls attached to the first side of the support, the side walls of the first pocket extending upward from the bottom wall, and a front wall extending upward from the bottom wall, the bottom wall extending laterally from the front edge of the support to a position intermediate to the ends of the top edge of the support, the side walls extending downward from the top edge of the support to a position intermediate to the ends of the upper rear edge of the support;

a second pocket having a front side, a bottom edge attached to the first side of the support, the bottom edge of the second pocket being coextensive with the upper bottom edge of the support, a first side edge attached to the upper rear edge of the support, and a second side edge attached to the first side of the support, the second side edge of the second pocket being substantially collinear with the lower rear edge of the support, the side edges of the second pocket extending upward from the bottom edge of the second pocket to a position intermediate to the ends of the upper rear edge of the support;

a third pocket for holding elongated substantially cylindrical objects, the third pocket having a bottom edge attached to the lower bottom edge of the support, the bottom edge of the third pocket being coextensive with the lower bottom edge of the support, a first side edge attached to the front edge of the support, a second side edge attached to the lower rear edge of the support, and a top edge inclined upwardly from the first side edge of the third pocket, the side edges of the third pocket extending upward from the bottom edge of the third pocket to a position intermediate to the ends of the front edge of the support;

a fourth pocket for holding an oblong tool, the fourth pocket having a first side edge attached to the first side edge of the second pocket, a second side edge attached to the front side of the second pocket, and a bottom edge attached to the front side of the second pocket;

a fifth pocket for holding an elongated cylindrical writing instrument, the fifth pocket having a first side edge attached to the first side edge of the third pocket, a second side edge attached to the front side of the third pocket, a substantially circular bottom wall attached to the first side of the support, the bottom wall of the third pocket extending outward from the front side of the third pocket, and a substantially cylindrical front wall extending upward from the bottom wall of the fifth pocket;

a flap member having a bottom edge, the flap member extending downward from the top edge of the support to an upper portion of the second side of the support, the bottom edge of the flap member being attached to the second side of the support to receive the belt of a user; and a means for fastening the bottom edge of the support to the thigh of the user.

2. A tool holder according to claim 1 wherein the interior of the third pocket has a plurality of loops for separating said elongated substantially cylindrical objects.

3. The tool holder according to claim 1 in which the fastening means comprises:

a lateral strap having two ends, the strap being attached to the lower bottom edge of the support at a position intermediate to the ends of the strap; and a releasable coupling having a latch and a clasp, the clasp being connected to one end of the lateral strap and the latch being connected to the other end of the lateral strap, said fastening means having a means for adjusting the length of the lateral strap.

4. A tool holder according to claim 1 wherein the support and the pockets are made from a wear resistant material.

5. A tool holder according to claim 1 wherein the support and the pockets are made from a material selected from the group consisting of cotton based textiles, polyester fabrics, acetate based fabrics, polyurethane fabrics, polyamide fabrics, and polyvinyl chloride fabrics.

6. A tool holder according to claim 1 wherein the support is made from a material that can be folded upon itself without permanently deforming.

7. A tool holder according to claim 1 wherein the elongated substantially cylindrical objects are selected from the group consisting of drill bits, hole punches, allen wrenches, nail sets, files, and screwdrivers.

8. A tool holder according to claim 1 wherein the oblong tool is selected from the group consisting of razor knives, wire strippers, fuse pullers, ratchets, and pocket knives.

* * * * *